United States Patent [19]

Lindal

[11] 4,097,162

[45] Jun. 27, 1978

[54] MORTISE AND TENON JOINT

[76] Inventor: Sir Walter Lindal, Suite 1201, 1120-8th Ave., Seattle, Wash. 98101

[21] Appl. No.: 708,409

[22] Filed: Jul. 26, 1976

[51] Int. Cl.[2] ..... B25G 3/00

[52] U.S. Cl. ..... 403/264; 52/730; 52/585

[58] Field of Search ..... 52/753 L, 753 T, 753 K, 52/730, 733, 622, 730, 629, 585; 403/230, 264, 403; 46/26; 85/13

[56] References Cited

U.S. PATENT DOCUMENTS

| | | | |
|---|---|---|---|
| 656,364 | 8/1900 | McDowell | 52/715 X |
| 1,488,726 | 4/1924 | Alexander et al. | 52/715 |
| 2,277,758 | 3/1942 | Hawkins | 52/753 L UX |
| 2,765,581 | 10/1956 | Adler | 46/26 |
| 3,605,360 | 9/1971 | Lindal | 52/730 X |

*Primary Examiner*—Wayne L. Shedd
*Attorney, Agent, or Firm*—Christopher Duffy

[57] ABSTRACT

Each construction member comprises a pair of mutually opposing, normally strip-like bodies of wood or other fastener impalable material, which are abutted face-to-face with one another on a common axis and adapted to define an axially extending slot at the interface therebetween. It also comprises an elongated strip of metal-like reinforcing material which is interposed in the slot and equipped with integral tooth-like fasteners on the longitudinally extending edges thereof which are oppositely disposed to one another from edge-to-edge of the strip and impaled in the bodies of fastener impalable material adjacent opposite sides of the slot. To this extent, pairs of the members may be modular. However, where a pair of members are to be interengaged with one another in a mortise and tenon joint, then the bodies of fastener impalable material in one of the members are coterminated with one another at corresponding axial ends thereof, and the metal-like strip therebetween is projected beyond the terminal ends of the bodies to form a tenon on that end of the member. Moreover, the bodies of fastener impalable material in the other member are adapted so that they define a cross-axial groove at the interface therebetween, which is disposed on the opposite side of the interface from the axially extending slot in the respective member, and opens into one axially extending edge of the member to form a mortise for the tenon of the first mentioned member.

28 Claims, 6 Drawing Figures

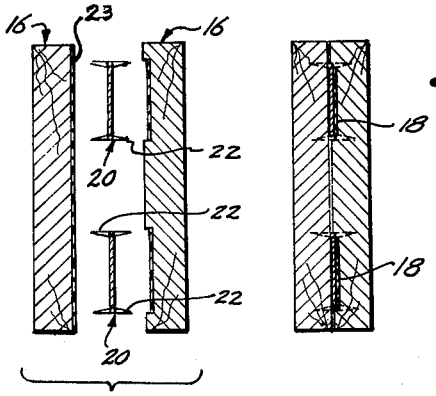
Fig. 2
Fig. 3.
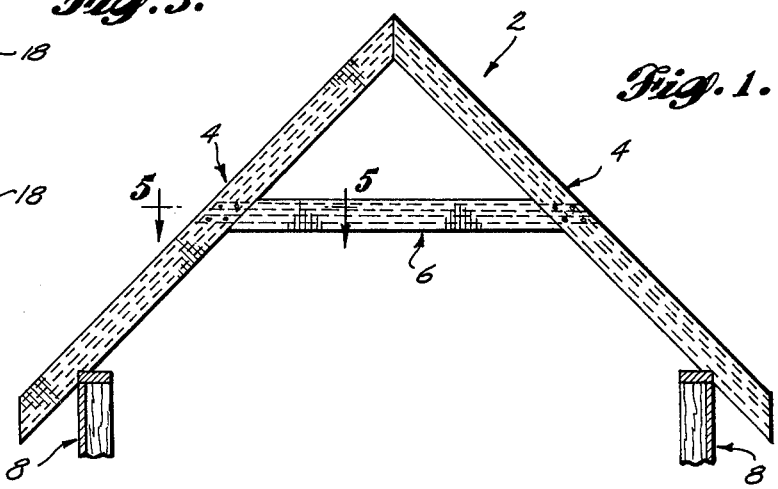
Fig. 1.
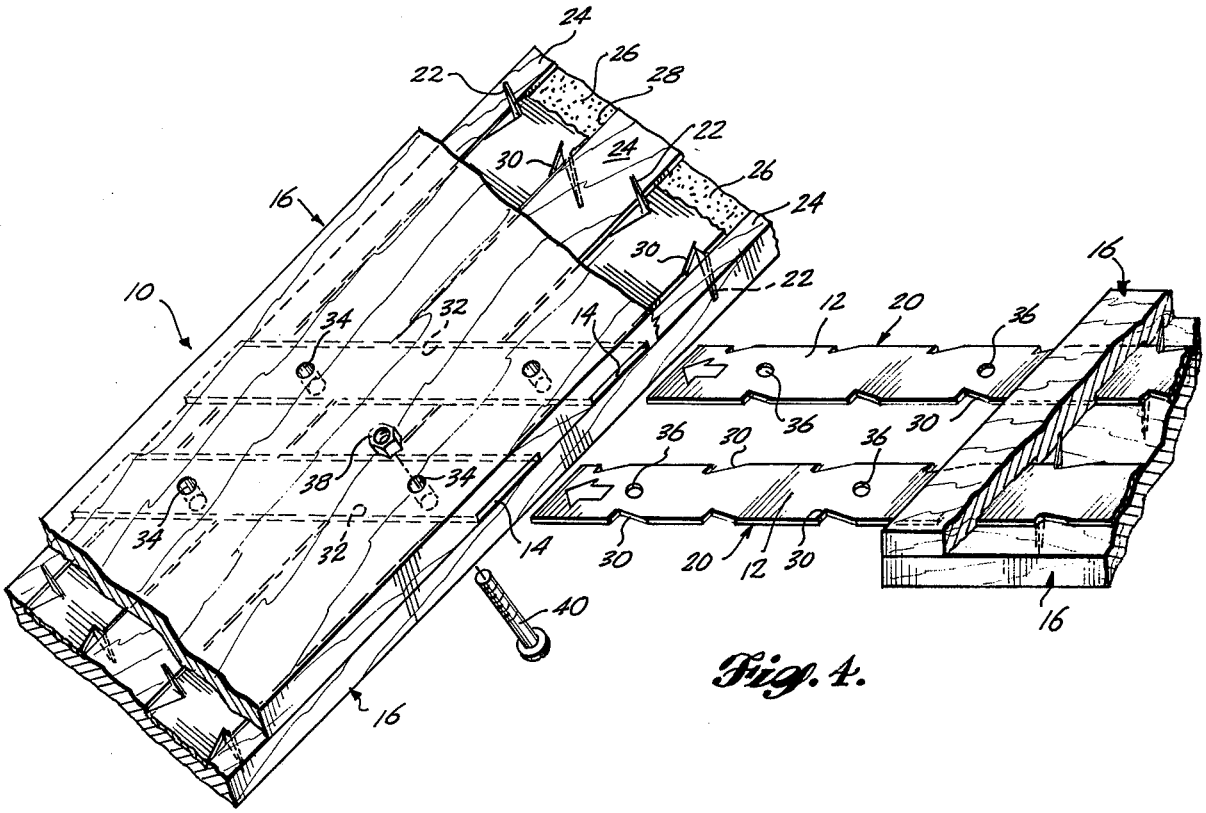
Fig. 4.
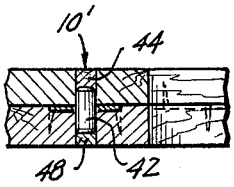
Fig. 6.
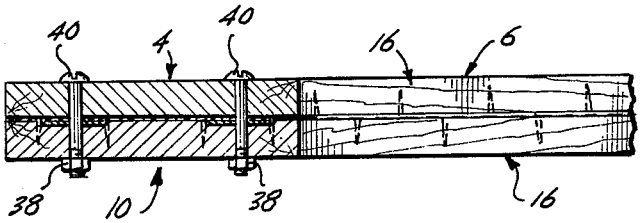
Fig. 5.

MORTISE AND TENON JOINT

THE INVENTION IN GENERAL

This invention relates to a laminated, metal reinforced construction member; and in particular to a construction member of this nature which has a mortise and tenon joint forming capability between pairs thereof.

According to the invention, each construction member comprises a pair of mutually opposing, normally strip-like bodies of wood or other fastener impalable material, which are abutted face-to-face with one another on a common axis and adapted to define an axially extending slot at the interface therebetween. It also comprises an elongated strip of metal-like reinforcing material which is interposed in the slot and equipped with integral tooth-like fasteners on the longitudinally extending edges thereof which are oppositely disposed to one another from edge-to-edge of the strip and impaled in the bodies of fastener impalable material adjacent opposite sides of the slot. Each may also include a layer of adhesive material which is disposed at the interface between the bodies of fastener impalable material to form an adhesive bond therebetween. Also, if the metal strip and slot are complimentary in size and cross section, there may be layers of adhesive material on the aforementioned sides of the slot, to form a bond between the metal strip and each of the bodies of fastener impalable material.

Preferably, all of the fasteners on each edge of the metal-like strip are oppositely disposed to those on the other edge.

To this extent, pairs of the members may be modular. However, where a pair of members are to be interengaged with one another in a mortise and tenon joint, then the bodies of fastener impalable material in one of the members are coterminated with one another at corresponding axial ends thereof, and the metal-like strip therebetween is projected beyond the terminal ends of the bodies to form a tenon on that end of the member. Moreover, the bodies of fastener impalable material in the other member are adapted so that they define a cross axial groove at the interface therebetween, which is disposed on the opposite side of the interface from the axially extending slot in the respective member, and opens into one axially extending edge of the member to form a mortise for the tenon of the first mentioned member. In addition, the fasteners are normally removed from the tenon of the first mentioned member, and the cross axial groove in the mortised member is adapted so that it is complimentary in size and cross section to the body of the tenon, to slidably receive the same.

The cross axial groove may intersect the slot at the interface of the mortised member, and in such a case the fasteners on the metal strip in the mortised member may also be removed from the same at the groove, to enable the tenon to slide face-to-face with the metal strip when the tenon is inserted in the groove. Additionally, the groove in the mortised member may open into the opposing axially extending edge of the member, so that it forms a slot between the respective edges of the member.

In the presently preferred embodiments of the invention, one of the bodies of fastener impalable material in each construction member is plain-faced and the other has an axially extending groove in the face thereof, so that together they define the slot for the metal-like strip. Also, where a member is mortised, the cross axial groove is formed in the plain-forced body of fastener impalable material, so that the cross axial groove is disposed on the opposite side of the interface from the axially extending slot for the metal strip therein.

Normally, the various grooves and metal strips are flat and rectangular in cross section, and are complimentarily sized. The metal strips have indentations in the longitudinally extending edges thereof, formed by cutting and bending the metal-like material of each relatively out of the main body plane of the strip at the sites of the fasteners, to form the same. Preferably, the fasteners are bent at right angles to the main body plane of the strip.

Since the fasteners on the tenon are removed, it has indentations in the longitudinally extending edges thereof at the sites of the fasteners, but its faces are plain and flat.

After a mortise and tenon joint is made between two of the members, they may be rigidly interconnected with one another by inserting a pin in registering holes in the tenon and the mortised member, respectively. Also, the pin may be of longer length than the cross sectional width of the mortised member, and may be equipped with a clamping means such as a nut and bolt combination, to clamp the assembly together at the connection. Alternatively, the pin may be of lesser length than the cross sectional width of the mortised member, and the pin connection may be concealed within the joint by adding plugs to the holes in the mortised member, after the pin has been inserted across the joint.

BRIEF DESCRIPTION OF THE DRAWING

These features will be better understood by reference to the accompanying drawing wherein three construction members are interconnected with one another so as to form a truss-like roof frame.

In the drawing,

FIG. 1 is an end elevational view of the frame;

FIG. 2 is an exploded cross sectional view of one member in the frame;

FIG. 3 is an assembled cross sectional view of the same;

FIG. 4 is an exploded part cutaway view of a mortise and tenon joint in the frame;

FIG. 5 is a part cross sectional view of the joint along the line 5—5 of FIG. 1; and FIG. 6 is a part cross sectional view of the joint along the same line, but with a concealed pin connection in the joint.

DESCRIPTION OF THE PREFERRED EMBODIMENT

Referring to the drawing, it will be seen that the frame 2 (FIG. 1) comprises a pair of rafter-like chordal members 4, and a collar-like cross member 6. The rafter-like members 4 rest on a pair of supports 8, and the collar-like member 6 is interconnected at its ends with and between the rafter-like members. Each connection between the members takes the form of a mortise and tenon joint, such as one of those illustrated at 10 and 10' in FIGS. 4–6. The joint is made by modifying the collar-like member to form a pair of tenons 12 on the respective axial end thereof, and by engaging the tenons in a pair of mortises 14 midway in the length of the adjacent rafter-like member, as shall be explained.

Basically, the three members 4 and 6 are modular in construction. Each comprises a pair of mutually opposing strip-like bodies 16 (FIG. 2) of wood or other fastener impalable material, and the bodies 16 are abutted face-to-face with one another (FIG. 3) on a common longitudinal axis and adapted to define a pair of spaced axially extending slots 18 at the interface therebetween. Each member also comprises a pair of elongated strips 20 of metal-like reinforcing material which are interposed in the slots 18 and are complimentary in size and cross section with the same. The strips are equipped with integral tooth-like fasteners 22 on the longitudinally extending edges thereof, and the fasteners are oppositely disposed to one another from edge-to-edge of the respective strips, and impaled in the bodies 16 of fastener impalable material, adjacent opposite sides of the respective slots 18. There is also a layer of adhesive 23 (FIG. 2) in each member at the interface 24 between the bodies of fastener impalable material; and layers 26 of adhesive material on the aforementioned sides of the slots, so that the metal strips and bodies of fastener impalable material are all adhesively bonded together in the member.

More specifically, one of the bodies 16 of fastener impalable material is plain-faced and the other has a pair of spaced axially extending grooves 28 in the face thereof, so that together they define the slots 18 for the metal strips 20. Also, the respective grooves 28 and strips 20 are flat and rectangular in cross section, and each strip 20 has indentations 30 in the longitudinally extending edges thereof, formed by cutting and bending the metal-like material of the same, relatively out of the main body plane of the strip at the sites of the fasteners 22 to form the same.

When each joint 10 or 10' is made, the bodies 16 of fastener impalable material in the collar-like member 6 are coterminated with one another at corresponding axial ends thereof, and the metal-like strips 20 therebetween are projected beyond the terminal ends of the bodies to form the tenons 12 on that end of the member. Moreover, the bodies 16 of fastener impalable material in the adjacent rafter-like member 4 are adapted to define a pair of spaced, parallel cross axial grooves 32 at the interface therebetween, which are disposed on the opposite side of the interface from the axially extending slos 18 therein, and open into one axially extending edge of the member 4, to form the mortises 14 for the tenons 12 of the collar-like member 6. In addition, the grooves 32 and tenons 12 are adapted so that they are complimentary in size and cross section, and the fasteners 22 on the strips 20 of the collar-like member are removed from the tenon portions of the same, so that the tenons can be slidably inserted in the mortises. Preferably, the grooves 32 in the rafter-like member also open into the opposing axially extending edge of the member, so as to form slot-like mortises between the edges thereof; and the fasteners 22 on the metal strips 20 in the member are stripped from the same at the grooves, to enable the tenons to slide face-to-face with the strips, and in fact, past the strips to the opposite ends of the mortises.

After a joint is made between a pair of members, they are rigidly interconnected by pinning them together at registering holes 34 and 36 in the rafter-like member and the tenons of the collar-like member, respectively. The pin for the connection may be of longer length than the cross sectional width of the rafter-like member, as in FIGS. 4 and 5 where nuts 38 and bolts 40 are employed to clamp the assembly together. Alternatively, a pin 42 of lesser length than the width of the rafter-like member, may be concealed within the joint by inserting plugs 44 and 48 in the holes of the rafter-like member, to conceal the connection. See FIG. 6.

The members are normally fabricated by assembling the bodies 16 and strips 20 in a press, and compressing the assembly to fasten and bond the respective components to one another. The strips may be sized to project at one or both ends of the assembly, to form the tenons; or the bodies of a member may be cut-down at the point of use for this purpose. Normally, the cross axial grooves 32 are formed in the plain-faced body at the time of assembly.

In other preferred embodiments of the invention, the fasteners 22 are alternately oppositely disposed along each longitudinally extending edge of the strips 20.

What is claimed is:

1. A construction member comprising a pair of mutually opposing, normally strip-like bodies of wood or other fastener impalable material, which are abutted face to face with one another along a common axis to form the main body of the member, and define an elongated, axially extending slot at the interface therebetween which extends substantially full length of the member and opens at corresponding axial ends of the bodies of fastener impalable material, said slot having defining surfaces thereof which are mutually opposed to one another on the bodies across the interface, and there being an elongated strip of metal-like reinforcing material interposed in the slot face to face with said surfaces and extending lengthwise of the slot substantially the full length thereof, said metal-like strip having integral tooth-like fasteners on the longitudinally extending edges thereof which are impaled in the bodies of fastener impalable material at the aforesaid surfaces of the slot to rigidly interconnect the bodies across the interface, said bodies of fastener impalable material substantially co-terminating with one another at the aforesaid axial ends thereof, and a portion of said metal-like strip projecting from the slot beyond said axial ends of the bodies of fastener impalable material to form a tenon on that end of the member.

2. The construction member according to claim 1 further comprising a layer of adhesive material which is disposed at the interfacial joint between the bodies of fastener impalable material to form an adhesive bond therebetween.

3. The construction member according to claim 1 wherein the metal strip and slot are complementary in size and cross section.

4. The construction member according to claim 1 wherein the metal strip and slot are complimentary in size and cross section and there are layers of adhesive material on the aforementioned surfaces of the slot, to form a bond between the metal strip and each of the bodies of fastener impalable material.

5. The construction member according to claim 1 wherein the fasteners are absent from the tenon portion of the metal strip.

6. The construction member according to claim 1 wherein the bodies of fastener impalable material also define a cross axial groove at the interface therebetween, which is disposed on the opposite side of the interface from the axially extending slot in the member, and opens into at least one axially extending edge of the member to form a mortise for the tenon of a mortise and tenon joint.

7. The construction member according to claim 6 wherein the fasteners are absent from the metal strip at the groove, to enable the tenon to slide face-to-face with the metal strip when it is inserted in the groove.

8. The construction member according to claim 7 wherein the groove opens into the opposing axially extending edge of the member, so that it forms a slot between the respective edges of the member.

9. The construction member according to claim 6 wherein one of the bodies of fastener impalable material is plainfaced and the other has an axially extending groove in the face thereof, so that together they define the slot for the metal-like strip, and wherein the cross axial groove is formed in the plainfaced body of fastener impalable material, so that the cross axial groove is disposed on the opposite side of the interface from the axially extending slot for the metal strip.

10. The construction member according to claim 1 wherein one of the bodies of fastener impalable material is plain faced and the other has an axially extending groove in the face thereof, so that together they define the slot for the metal-like strip.

11. The construction member according to claim 1 wherein the metal strip has indentations in the longitudinally extending edges of the portion thereof, at the sites of and corresponding to the fasteners in size.

12. The construction member according to claim 11 wherein the fasteners extend at right angles to the main body plane of the strip.

13. The construction member according to claim 1 wherein the tenon has indentations in the longitudinally extending edges thereof, at the sites of and corresponding to the fasteners in size.

14. A mortise and tenon joint comprising a pair of construction members, each of which comprises a pair of mutually opposing, normally strip-like bodies of wood or other fastener impalable material, which are abutted face to face with one another along a common axis to form the main body of the member, and define an elongated, axially extending slot at the interface therebetween which extends substantially full length of the member and opens at corresponding axial ends of the bodies of fastener impalable material, said slot having defining surfaces thereof which are mutually opposed to one another on the bodies across the interface, and there being an elongated strip of metal-like reinforcing material interposed in the slot face to face with said surfaces and extending lengthwise of the slot substantially the full length thereof, said metal-like strip having integral tooth-like fasteners on the longitudinally extending edges thereof which are impaled in the bodies of fastener impalable material at the aforesaid surfaces of the slot to rigidly interconnect the bodies across the interface, said bodies of fastener impalable material in one of the construction members substantially co-terminating with one another at the aforesaid axial ends thereof, and a portion of said metal-like strip in the one construction member projecting from the slot thereof beyond said axial ends of the bodies of fastener impalable material to form a tenon on that end of the one member, the bodies of fastener impalable material in the other construction member defining a cross axial groove at the interface therebetween, which is disposed on the opposite side of the interface from the axially extending slot in said other member, and opens into one axially extending edge of the other member to form a mortise therein, the tenon of the one construction member being inserted in the mortise of the other construction member, and there being an aperture in the tenon and apertures in the bodies of fastener impalable material in the other construction member which register with the aperture in the tenon, and means passing through the aperture in the tenon and interposed in the respective apertures in the bodies of fastener engagable material in the other construction member, to interlock the members across the mortise and tenon joint.

15. The joint according to claim 14 wherein the fasteners are absent from the tenon portion of the one member and the cross axial groove in the other member is complimentary in size and cross section to the body of the tenon.

16. The joint according to claim 15 wherein the fasteners are absent from the metal strip in the other member at the groove, and the tenon is face-to-face with the metal strip of the other member in the groove.

17. The joint according to claim 16 wherein the groove in the other member opens into the opposing axially extending edge of the member, so that it forms a slot between the respective edges of the member.

18. The joint according to claim 14 wherein one of the bodies of fastener impalable material in each member is plain faced and the other has an axially extending groove in the face thereof, so that together they define the slot for the metal-like strip, and wherein the cross axial groove in the other member is formed in the plainfaced body of fastener impalable material, so that the cross axial groove is disposed on the opposite side of the interface from the axially extending slot for the metal strip therein.

19. The joint according to claim 18 wherein the various grooves and the metal strip are flat and rectangular in cross section and are complimentarily sized.

20. The joint according to claim 18 wherein each metal strip has indentations in the longitudinally extending edges thereof, at the sites of and corresponding to the fasteners in size, to form the same, the fasteners being absent from the tenon and the metal strip of the other member at the cross axial groove, so that the faces of the same are plain and flat.

21. The joint according to claim 14 wherein the tenon and the aforesaid other member have registering holes therein, and there is a pin inserted in the same to rigidly interconnect the members.

22. The joint according to claim 21 wherein the pin is of longer length that the cross sectional width of the aforesaid other member, and equipped with clamping means to clamp the assembly together at the connection.

23. The joint according to claim 21 wherein the pin is of lesser length than the cross sectional width of the aforesaid other member, and there are plugs in the holes of the other member to conceal the pin connection within the joint.

24. The construction member according to claim 1 wherein the fasteners on one edge of the strip are oppositely disposed to the fasteners on the other edge thereof, crosswise of the interface.

25. A construction member comprising a pair of mutually opposing, normally strip-like bodies of wood or other fastener impalable material, which are abutted face to face with one another along a common axis and define an axially extending slot at the interface therebetween, and an elongated strip of metal-like reinforcing material interposed in the slot, at least a portion of which is equipped with integral tooth-like fasteners on the longitudinally extending edges thereof that are impaled in the bodies of fastener impalable material adjacent opposite sides of the slot to rigidly interconnect the bodies across the interface, said bodies substantially co-terminating with one another at corresponding axial ends thereof, and the metal-like strip therebetween projecting beyond the terminal ends of the bodies to form a tenon on that end of the member, said bodies of fastener impalable material also defining a cross axial groove at the interface therebetween, which is disposed on the opposite side of the interface from the axially extending slot in the member, and opens into the opposing axially extending edges of the member, so that it forms a slot between the respective edges of the member, to act as a mortise for the tenon of a mortise and tenon joint, the fasteners being absent from the metal strip at the groove, to enable the tenon to slide face to face with the metal strip when it is inserted in the groove.

26. A mortise and tenon joint comprising a pair of construction members, each of which comprises a pair of mutually opposing, normally strip-like bodies of wood or other fastener impalable material, which are abutted face to face with one another on a common axis and define an axially extending slot at the interface therebetween, and an elongated strip of metal-like reinforcing material which is interposed in the slot, at least a portion of which is equipped with integral tooth-like fasteners on the longitudinally extending edges thereof that are impaled in the bodies of fastener impalable material adjacent opposite sides of the slot, the bodies of fastener impalable material in one of the pair of members substantially co-terminating with one another at corresponding axial ends thereof, and a portion of the metal-like strip therebetween projecting beyond the terminal ends of the bodies to form a tenon on that end of the member, the bodies of fastener impalable material in the other member defining a cross axial groove at the interface therebetween, which is disposed on the opposite side of the interface from the axially extending slot in the respective member, and opens into the opposing axially extending edges of said other member to form a mortise therein, said groove being complementary in size and cross section to the body of the tenon portion of the one member and said tenon portion being engaged in the mortise of the other member, the fasteners being absent from the tenon portion of the one member and from the metal strip in the other member at the groove, and the tenon portion being face to face with the metal strip of the other member in the groove.

27. A mortise and tenon joint comprising a pair of construction members, each of which comprises a pair of mutually opposing, normally strip-like bodies of wood or other fastener impalable material, which are abutted face to face with one another on a common axis and define an axially extending slot at the interface therebetween, and an elongated strip of metal-like reinforcing material which is interposed in the slot, at least a portion of which is equipped with integral tooth-like fasteners on the longitudinally extending edges thereof that are impaled in the bodies of fastener impalable material adjacent opposite sides of the slot, the bodies of fastener impalable material in one of the pair of members substantially co-terminating with one another at corresponding axial ends thereof, and the metal-like strip therebetween projecting beyond the terminal ends of the bodies to form a tenon on that end of the member, the bodies of fastener impalable material in the other member defining a cross axial groove at the interface therebetween, which is disposed on the opposite side of the interface from the axially extending slot in the respective member, and opens into the opposing axially extending edges of said other member to form a mortise therein, the tenon of the one member being engaged in the mortise of the other member and the tenon and the other member having registering holes therein, there being a pin inserted in the holes to rigidly interconnect the members, which pin is of longer length than the cross sectional width of the other member, and equipped with clampmeans to clamp the assembly together at the connection.

28. A mortise and tenon joint comprising a pair of construction members, each of which comprises a pair of mutually opposing, normally strip-like bodies of wood or other fastener impalable material, which are abutted face to face with one another on a common axis and define an axially extending slot at the interface therebetween, and an elongated strip of metal-like reinforcing material which is interposed in the slot, at least a portion of which is equipped with integral tooth-like fasteners on the longitudinally extending edges thereof that are impaled in the bodies of fastener impalable material adjacent opposite sides of the slot, the bodies of fastener impalable material in one of the pair of members substantially co-terminating with one another at corresponding axial ends thereof, and the metal-like strip therebetween projecting beyond the terminal ends of the bodies to form a tenon on that end of the member, the bodies of fastener impalable material in the other member defining a cross axial groove at the interface therebetween, which is disposed on the opposite side of the interface from the axially extending slot in the respective member, and opens into the opposing axially extending edges of said other member to form a mortise therein, the tenon of the one member being engaged in the mortise of the other member and the tenon and the other member having registering holes therein, there being a pin inserted in the holes to rigidly interconnect the members, which pin is of lesser length than the cross sectional width of the other member, there being plugs in the holes of the other member to conceal the pin connection within the joint.

* * * * *